US010697444B2

(12) United States Patent
Dainez et al.

(10) Patent No.: US 10,697,444 B2
(45) Date of Patent: Jun. 30, 2020

(54) ACTUATION SYSTEM FOR A RESONANT LINEAR COMPRESSOR, METHOD FOR ACTUATING A RESONANT LINEAR COMPRESSOR, AND RESONANT LINEAR COMPRESSOR

(71) Applicant: EMBRACO INDÚSTRIA DE COMPRESSORES E SOLUçÕES EM REFRIGERAçÃO LTDA, Joinville (BR)

(72) Inventors: Paulo Sergio Dainez, Campinas (BR); Dietmar Erich Bernhard Lilie, Joinville (BR)

(73) Assignee: Embraco Indústria de Compressores e Soluções em Refrigeração Ltda. (BR)

( * ) Notice: Subject to any disclaimer, the term of this patent is extended or adjusted under 35 U.S.C. 154(b) by 659 days.

(21) Appl. No.: 15/429,851

(22) Filed: Feb. 10, 2017

(65) Prior Publication Data

US 2017/0152847 A1 Jun. 1, 2017

Related U.S. Application Data

(62) Division of application No. 14/005,127, filed as application No. PCT/BR2012/000066 on Mar. 15, 2012.

(30) Foreign Application Priority Data

Mar. 15, 2011 (BR) ..... 1101094

(51) Int. Cl.
*F04B 35/04* (2006.01)
*F04B 49/06* (2006.01)

(52) U.S. Cl.
CPC ..... *F04B 35/045* (2013.01); *F04B 49/065* (2013.01); *F04B 2201/0201* (2013.01);
(Continued)

(58) Field of Classification Search
CPC ..... F04B 2203/0401; F04B 2203/0402; F04B 35/045; F04B 49/065; F04B 2203/0404;
(Continued)

(56) References Cited

U.S. PATENT DOCUMENTS 5,897,296 A 4/1999 Yamamoto et al.
5,980,211 A 11/1999 Tojo et al.
(Continued)

FOREIGN PATENT DOCUMENTS

DE 103 14 007 10/2004
EP 1 607 631 12/2005
(Continued)

OTHER PUBLICATIONS

International Search Report dated Nov. 22, 2012 for International application No. PCT/BR2012/000066.
(Continued)

*Primary Examiner* — Kenneth J Hansen
(74) *Attorney, Agent, or Firm* — Fay Sharpe LLP

(57) ABSTRACT

An actuation system for a resonant linear compressor (50) is disclosed, applied to cooling systems, the latter being particularly designed to operate at the electromechanical frequency of said compressor (50), so that the system will be capable of raising the maximum power supplied by the linear actuator, in conditions of overload of said cooling system. Additionally, an actuation method for a resonant linear compressor (50) is provided, the operation steps of which enable one to actuate the equipment at the electromechanical resonance frequency, as well as to control the actuation thereof in over load conditions.

6 Claims, 13 Drawing Sheets

(52) U.S. Cl.
CPC ..... *F04B 2201/0202* (2013.01); *F04B 2203/0401* (2013.01); *F04B 2203/0402* (2013.01)

(58) Field of Classification Search
CPC ..... F04B 2201/0201; F04B 2201/0202; F04B 2201/0806
See application file for complete search history.

(56) References Cited

U.S. PATENT DOCUMENTS

| | | | | |
|---|---|---|---|---|
| 6,520,746 | B2 | 2/2003 | Yoo et al. | |
| 6,832,898 | B2 | 12/2004 | Yoshida et al. | |
| 7,259,533 | B2 | 8/2007 | Yang et al. | |
| 7,665,972 | B2 | 2/2010 | Yoo et al. | |
| 2003/0026703 | A1* | 2/2003 | Yoo | F04B 35/045 417/44.11 |
| 2003/0175125 | A1* | 9/2003 | Kwon | F04B 35/045 417/44.11 |
| 2005/0031470 | A1 | 2/2005 | Lee | |
| 2005/0271526 | A1 | 12/2005 | Chang et al. | |
| 2006/0056980 | A1* | 3/2006 | Yoo | F04B 35/045 417/44.11 |
| 2007/0241698 | A1 | 10/2007 | Sung et al. | |

FOREIGN PATENT DOCUMENTS

| | | |
|---|---|---|
| KR | 96 15062 | 10/1999 |
| KR | 96 79125 | 1/2000 |
| WO | WO 00/79671 | 12/2000 |

OTHER PUBLICATIONS

Written Opinion dated Nov. 22, 2012 for International application No. PCT/BR2012/000066.

International Preliminary Report on Patentability completed Jun. 27, 2013 for International application No. PCT/BR2012/000066.

* cited by examiner

ACTUATION SYSTEM FOR A RESONANT LINEAR COMPRESSOR, METHOD FOR ACTUATING A RESONANT LINEAR COMPRESSOR, AND RESONANT LINEAR COMPRESSOR

CROSS REFERENCE TO RELATED APPLICATIONS

This application is a divisional of U.S. application Ser. No. 14/005,127 filed Feb. 20, 2014 (02/20/2014), which is the U.S. National Phase of PCT International application No. PCT/BR2012/000066 filed Mar. 15, 2012 (03/15/2012), which claims priority from and benefit of the filing date of Brazilian Application No. PI1101094-0 filed Mar. 15, 2011 (03/15/2011), and the entire disclosure of each of these applications is hereby expressly incorporated by reference into the present application.

The present invention relates to an actuation system for a resonant linear compressor, applied to cooling systems, the latter being particularly designed to operate at the electromechanical resonance of said compressor, so that the system will be capable of raising the maximum power supplied by the linear actuator, in conditions of overload of said cooling system Additionally, the present invention relates to an actuating method for a resonant linear compressor, the operation steps of which enable one to actuate the equipment at the electromechanical resonance frequency, as well as to control the actuation thereof in overload condition.

Finally, the present invention relates to a resonant linear compressor provided with an actuating system as proposed in the presently claimed object.

DESCRIPTION OF THE PRIOR ART

The known alternating-piston compressors operate to the effect of generating a pressure to compress the gas inside a cylinder, employing an axial movement of the piston, so that the gas on the low-pressure side, called also suction pressure or evaporation pressure, will get into the cylinder through the suction valve.

The gas is then compressed within the cylinder by the piston movement and, after being compressed, it comes out of the cylinder through the discharge valve to the high-pressure valve, called also discharge pressure or condensation.

In the case of resonant linear compressors, the piston is actuated by a linear actuator that is formed by a support and magnets, which may be actuated by one or more coils. Such a linear compressor further comprises one or more springs, which connect the movable part (piston, support and magnets) to the fixed part, the latter being formed by the cylinder, stator, coil, head and structure. The movable parts and the springs form the resonant assembly of the compressor.

Said resonant assembly, actuated by the linear motor, has the function of developing a linear alternating motion, causing the movement of the piston inside the cylinder to exert an action of compressing the gas admitted by the suction valve, until it can be discharged through the discharge valve to the high-pressure side.

The operation range of the linear compressor is regulated by the balance of the power generated by the motor with the power consumed by the compression mechanism, besides the losses generated in this process. In order to achieve maximum thermodynamic efficiency and maximum cooling capacity, it is necessary for the maximum displacement of the piston to approach as much as possible the stroke end, thus reducing the dead gas volume in the compression process.

To make the process feasible, it becomes necessary for the piston stroke to be known in great accuracy, so as to present the risk of impact of the piston at the stroke end with the equipment head. This impact might generate loss of efficiency of the apparatus of even break of the compressor, in addition to generating acoustic noise.

Thus, the greater the error in estimating/measuring the piston position, the greater the safety coefficient required between the maximum displacement and the stroke end, in order to operate the compressor in safety, which leads to loss of performance of the product.

On the other hand, if it is necessary to reduce the cooling capacity of the compressor due to less need of the cooling system, it is possible to reduce the maximum operation piston stroke, reducing the power supplied to the compressor, and thus it is possible to control the cooling capacity of the compressor, obtaining a variable capacity.

An additional and quite important characteristic ion the operation of resonant linear compressors is their actuation frequency.

In general, resonant compressors are designed to function at the resonance frequency of the so-called mass/spring system, a condition in which the efficiency is maximum and wherein the mass considered is given by the sum of the mass of the movable part (piston, support and magnets), and the equivalent spring ($K_T$) is taken from the sum of the resonant spring of the system ($K_{ML}$), plus the gas spring generated by the compression force of the gas ($K_G$), which has a behavior similar to a non-linear variable spring, and that depends upon the evaporation and condensation pressures of the cooling system, as well as upon the gas used in said system.

Some solutions of the prior art try to solve the problem of actuation frequency of resonant compressors for certain operation conditions, as well be set forth hereinafter.

Document WO 00079671A1 uses detection of counter electromotive force (CEMF) of the motor to adjust the resonance frequency, but this technique has the disadvantage that it needs a minimum time without current to detect crossing by zero of the CEMF, thus impairing the maximum power supplied and the efficiency by distortion in the wave form of the current.

In turn, U.S. Pat. No. 5,897,296 discloses a control with position sensor and frequency control to minimize the current. This solution is similar to those already available in the prior art and has the disadvantage one has to disturb the system periodically for adjustment of the actuation frequency, which may impair greatly the performance of the final product.

U.S. Pat. No. 6,832,898 describes a control of the operation frequency by the maximum of power for a constant current. This technique employs the same principle of the preceding patent, and to it has the same disadvantage of disturbing the system constantly.

All the above solutions, in addition to those disclosed by documents U.S. Pat. No. 5,980,211, KR0237562 and KR0176909, have the main objective of actuating the compressor at the resonance frequency of the mechanical system, regardless of the frequency adjustment method and, in this condition, the relationship between the displacement and the current is maximum (or velocity and current).

Although the efficiency is maximum at the mechanical resonance frequency, the feed voltage is not at the optimum point, that is, the relationship between the displacement and the feed voltage is not maximum at this frequency. So, depending on the design of the actuator and the load condition of the cooling system/and the compressor, the system may be limited by the maximum voltage which the control system can supply, limiting the maximum power of the system, or making the response time very long to lower the internal temperature of the cooling system, which may impair the preservation of the foods within the system.

A solution for this overload problem is the oversize of the linear actuator, which raises the cost and reduces the efficiency of the system in nominal condition.

On the basis of the foregoing, the present invention foresees a system and a method for actuating a piston of a resonant linear compressor, designed for supplying maximum power to the equipment in conditions of overload of the cooling system, reducing costs and raising the efficiency of the compressor it its nominal operation condition.

OBJECTIVES OF THE INVENTION

A first objective of the present invention is to propose an actuation system for a resonant linear compressor, which should be capable of actuating the compressor at its electromechanical resonance frequency, so as to provide maximum power to the equipment in conditions of overload of a cooling system.

A second objective of the present invention is to provide an actuation system for a resonant linear compressor, so that it will contribute significantly to better preservation of the foods stored in the refrigerator, by raising the maximum power supplied to the equipment compressor.

A third objective of the present invention is to reduce the manufacture cost of the resonant linear compressor by optimizing the size of its linear actuator.

A further objective of the present invention consists in optimizing the efficiency of the actuator in nominal operation condition, on the basis of the improvement obtained in the sizing thereof.

Finally, another objective of the present invention is to provide a substantially more simplified solution with respect to the prior techniques for production thereof on industrial scale.

BRIEF DESCRIPTION OF THE INVENTION

The objectives of the present invention are achieved by providing an actuation system for a resonant linear compressor, the resonant linear compressor being an integral part of a cooling circuit, the resonant linear compressor comprising at least one cylinder, at least one head, at least one electric motor and at least one spring, the cylinder housing a piston operatively, the actuation system comprising at least one electronic control of actuation of the electric motor, the electronic actuation control comprising at least one control circuit and at least one actuation circuit, which are associated to each other, the electronic actuation control being electrically associated to the electric motor of the linear compressor, the actuation system being configured to detect at least one overload condition of the linear compressor, through at least one electric magnitude measured, or estimated, by the electronic actuation control, and adjust, from a control mode in overload, the actuation frequency of the electric motor to an electromechanical resonance frequency or at an intermediate frequency between the mechanical resonance and the electromechanical resonance.

The objectives of the present invention are further achieved by providing an actuation method for a resonant linear compressor, the resonant linear compressor comprising at least one electric motor, the electric motor being actuated by a frequency inverter, the actuation method comprising the following steps:

a) measuring or estimating, at every operation cycle of the resonant linear compressor, an actuation or operation frequency, a maximum displacement of the piston of the resonant linear compressor and/or the displacement phase of the piston stroke and/or the velocity phase of the piston and/or the current phase;

b) comparing the maximum displacement of the piston with a maximum reference displacement, and calculating a displacement error;

c) calculating an operation feed voltage value of the electric motor from a operation feed voltage value of a preceding cycle and the displacement error obtained at the preceding step (s);

d) comparing the operation feed voltage value of the electric motor calculated at the preceding step with a maximum feed voltage value;

e) if the operation feed voltage value calculated at the step "c" is lower than or equal to the maximum feed voltage value, then deactivate the overload control mode of the electric control and decrease the actuation frequency down to a mechanical resonance frequency value; and returning to step a), f) if the operation feed voltage value calculated at the step "c" is higher than the maximum feed voltage value, then activate the overload control mode and increase the actuation frequency up to an electromechanical resonance frequency.

BRIEF DESCRIPTION OF THE DRAWINGS

The present invention will now be described in greater details with reference to the attached drawings, in which.

DETAILED DESCRIPTION OF THE FIGURES

Figure 1:
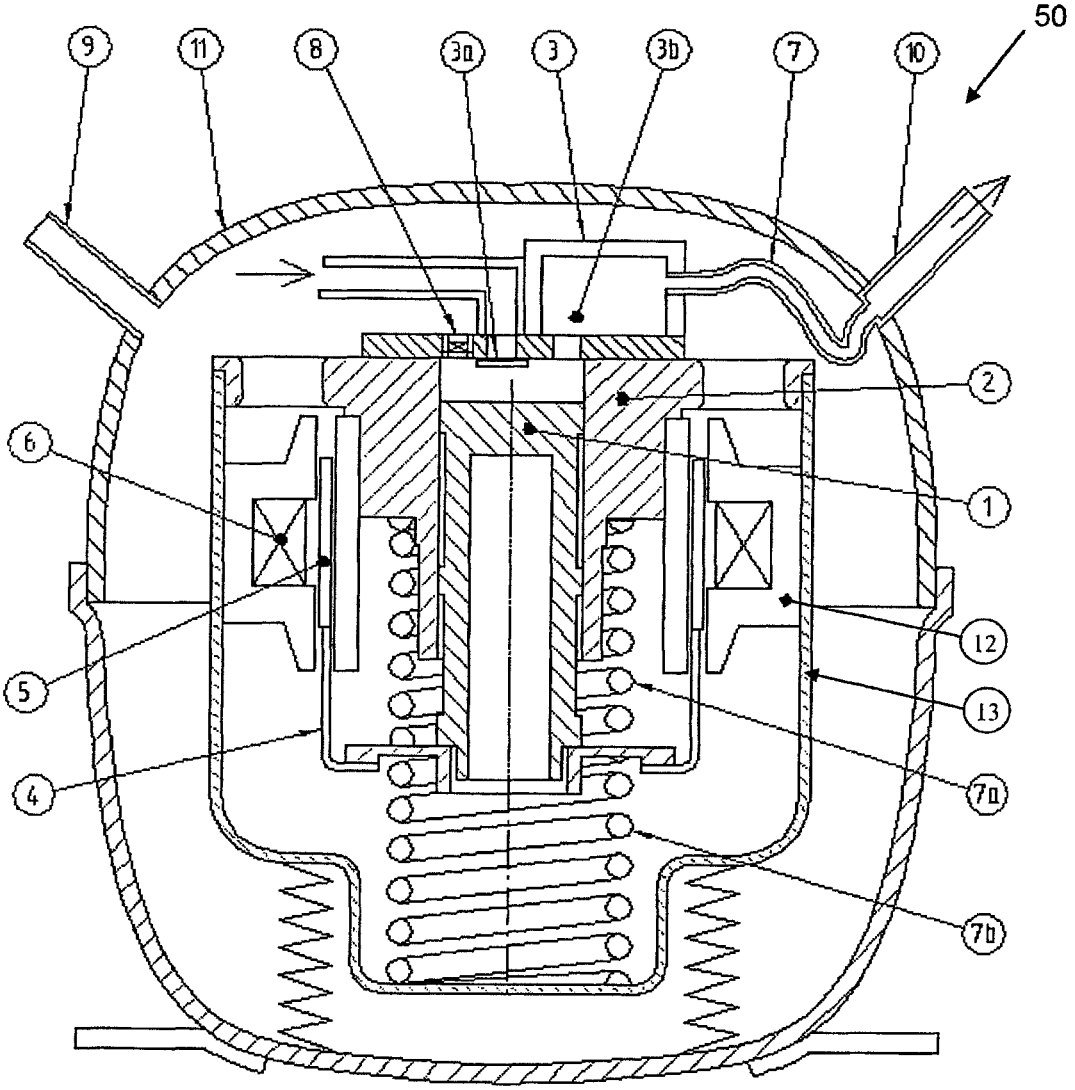
FIG. 1 represents a schematic view of a resonant linear compressor.
Figure 2:
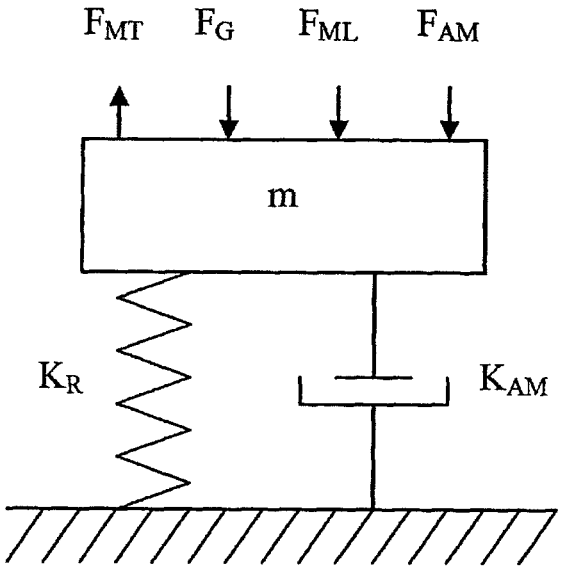
FIG. 2 illustrates a schematic view of the mechanical model of the resonant linear compressor employed in the present invention.
Figure 3:
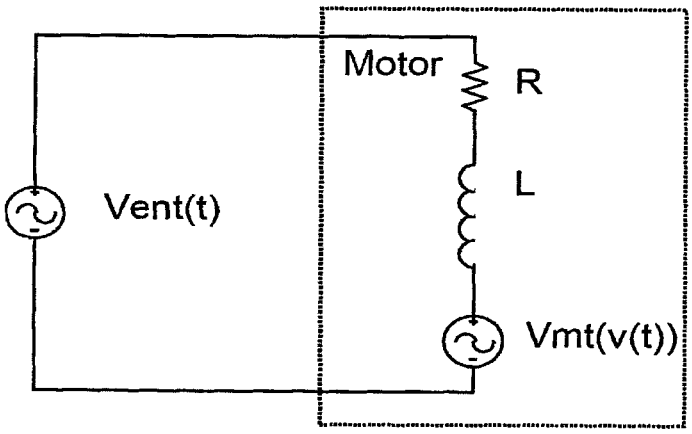
FIG. 3 illustrates a schematic view of the electric model of the resonant linear compressor of the present invention.

FIG. 1 shows a schematic view of a resonant linear compressor 50, object of the present invention.

A model of the linear compressor 50 is provided, such a mechanical model being defined on the basis of equation 1 below, and said electric model being defined from equation 2.

$$m \cdot \frac{d^2 d(t)}{dt^2} = F_{MT}(i(t)) - F_{ML}(d(t)) - F_{AM}(v(t)) - F_G(d(t)) \tag{1}$$

wherein:

$F_{MT}(i(t))=K_{MT} \cdot i(t)$—motor force [N];

$F_{ML}(d(t))=K_{ML} \cdot d(t)$—spring force [N];

$F_{AM}(v(t))=K_{AM} \cdot v(t)$—damping force [N];

$F_G(d(t))$—force of gas pressure in the cylinder [N];

$K_{MT}$—motor constant $K_{ML}$—spring constant $K_{AM}$—damping constant m—mass of the moveable par v(t)—piston velocity d(t)—piston displacement i(t)—motor current $$V_{ENT}(t)=V_R(i(t))+V_L(i(t))+V_{MT}(v(t)) \tag{2}$$

wherein:

$V_R(i(t))=R \cdot i(t)$—resistance voltage [V];

$$V_L(i(t)) = L \cdot \frac{di(t)}{dt} - \text{inductor voltage [V]};$$

$V_{MT}(v(t))=K_{MT} \cdot v(t)$—voltage induced in the motor or CEMF [V];

$V_{ENT}(t)$—feed voltage [V];

R—electric resistance of the motor

L—motor inductance.

It should be pointed out that, the gas pressure force ($F_G(d(t))$) is variable with the suction and discharge pressures, with the non-linear piston displacement, with the other forces in the mechanical equation they are all linear, just as all the voltages in the electric equation. In order to obtain the complete model of the system, it is possible to replace the pressure force by the effects which it causes in the system, which are power consumption and variation in the resonance frequency.

The power consumption may be modeled by an equivalent damping and the variation in the resonance frequency by an equivalent spring.

Thus, the equation (1) above may be rewritten as follows:

$$m \cdot \frac{d^2(t)}{dt^2} = K_{MT} \cdot i(t) - (K_{ML} + K_{MLEq}) \cdot d(t) - (K_{AM} + K_{AMEq}) \cdot v(t) \tag{3}$$

or $$m \cdot \frac{d^2(t)}{dt^2} = K_{MT} \cdot i(t) - K_{MLT} \cdot d(t) - K_{AMT} \cdot v(t) \tag{4}$$

wherein:

$K_{MLEq}$—equivalent spring coefficient $K_{AMEq}$—equivalent damping coefficient $K_{MLT}=K_{ML}+K_{MLEq}$—total spring coefficient $K_{AMT}=K_{AM}+K_{AMEq}$—total damping coefficient Applying the Laplace transform to the equations (2) and (4), one can obtain the equation (5) below, which represents the electric equation at the minimum of the frequency and the mechanical equations (6) and (7), which represent, respectively the function of transfer between displacement and velocity with the current.

$$I(s) = \frac{V_{ENT}(s) - K_{MT} \cdot V(s)}{L \cdot s + R} \tag{5}$$

$$\frac{D(s)}{I(s)} = \frac{K_{MT}}{m \cdot s^2 + K_{AMT} \cdot s + K_{MLT}} \tag{6}$$

$$\frac{V(s)}{I(s)} = \frac{K_{MT} \cdot s}{m \cdot s^2 + K_{AMT} \cdot s + K_{MLT}} \tag{7}$$

The equation (8) below represents the characteristic equation of the electric system, so that the equation (9) represents the characteristic equation of the mechanical system. The poles of this equation define the mechanical resonance frequency, region where the relationship between displacement/current, or velocity/current, is maximum, and therefore with maximum efficiency as well, just as described in other solutions of the prior art.

$$EC_E=L \cdot s+R \tag{8}$$

$$EC_M=m \cdot s^2+K_{AMT} \cdot s+K_{MLT} \tag{9}$$

Working out mathematically the equations (5) to (9), one can obtain the equations (10), (11) and (12), which represent, respectively, the function of transfer of the current, of the displacement and of the velocity of the piston of the compressor 50, as a function of the input voltage, for the complete electromechanical system, according to the teachings of the present invention:

$$\frac{I(s)}{V_{ENT}(s)} = \frac{EC_M}{EC_M \cdot EC_E + K_{MT}^2 \cdot s} \tag{10}$$

$$\frac{D(s)}{V_{ENT}(s)} = \frac{K_{MT}}{EC_M \cdot EC_E + K_{MT}^2 \cdot s} \tag{11}$$

$$\frac{V(s)}{V_{ENT}(s)} = \frac{K_{MT} \cdot s}{EC_M \cdot EC_E + K_{MT}^2 \cdot s} \tag{12}$$

One may further define the equation (13) or (14) below, as the characteristic equation of the electromechanical system designed in the present invention:

$$EC_S=EC_M \cdot EC+K_{MT}^2 \cdot s \quad (13)$$

or:

$$EC_S=m \cdot L \cdot s^3+(K_{AMT} \cdot L+m \cdot R) \cdot s^2+(K_{MLT} \cdot L+K_{AMT} \cdot R+K_{MT}^2) \cdot s+K_{MLT} \cdot R \quad (14)$$

The pair of complex poles of the characteristic equation of the electromechanical system above defines the electromechanical resonance frequency, the region in which one has greater relation between current, the displacement and the velocity with the input voltage. Therefore, this is a region where it is possible to obtain maximum power of the resonant linear compressor, as proposed in the present invention.

For a better understanding of the characteristics of the actuation system and method proposed, which will be described in greater details later, one presents the values in Table 1 below, which define the coefficients of a resonant linear compressor, designed to operate at a mechanical resonant frequency of 50 Hz, for a nominal load of 50 W.

TABLE 1

Coefficients of the resonant linear compressor

| Coefficient | Value | Unit |
|---|---|---|
| R | 12.9 | Ω |
| L | 0.75 | H |
| $K_{MT}$ | 70 | V · s/m or N/A |
| $K_{MLT}$ | 81029.5 | N/m |
| $K_{AMT}$ | 10 | N · s/m |
| m | 0.821 | Kg |

Figure 4:
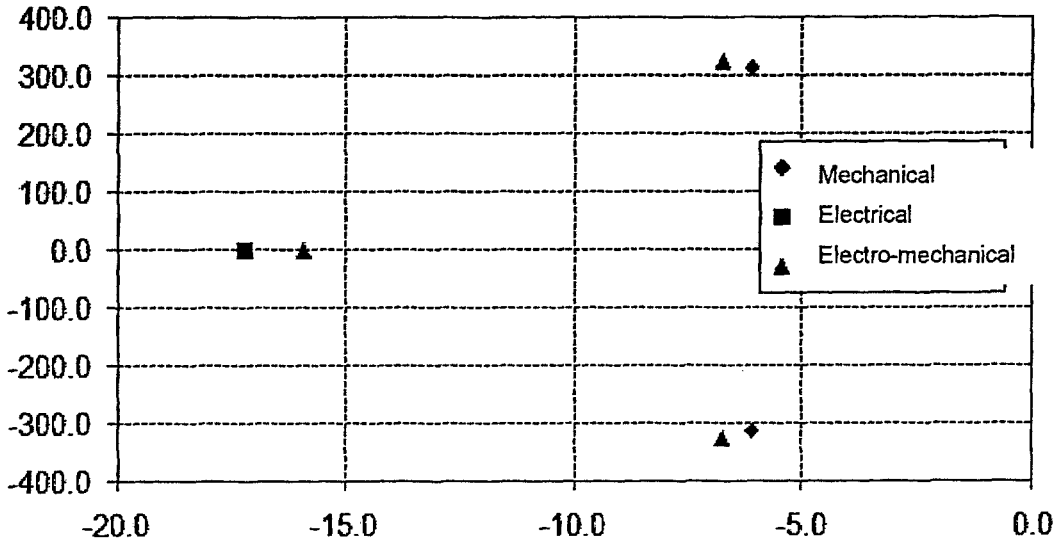
FIG. 4 shows a graph of the position of the poles of the electric, mechanical and complete system, according to the teachings of the present invention.

Calculating the poles of the electric system and mechanical system in isolation, and of the complete electromechanical system, one will visualize the alteration in the system poles, according to Table 2 below, and also from FIG. 4.

The mechanical resonance frequency is given by the module of the pair of complex poles of the characteristic equation of the mechanical system (314.2 rad/s or 50 Hz). The electromechanical resonance frequency is given by the module of the pair of complex poles of the characteristic equation of the electromagnetic system (326.6 rad/s or 51.97 Hz).

TABLE 2

Poles of the electric, mechanical and electromechanical system

| System | Poles Real | Poles Complex |
|---|---|---|
| Electric | 17.2 | — |
| Mechanical | — | 6.09 ± 3141j |
| Electromechanical | −15.9 | 6.73 ± 326.5j |

Figure 5:
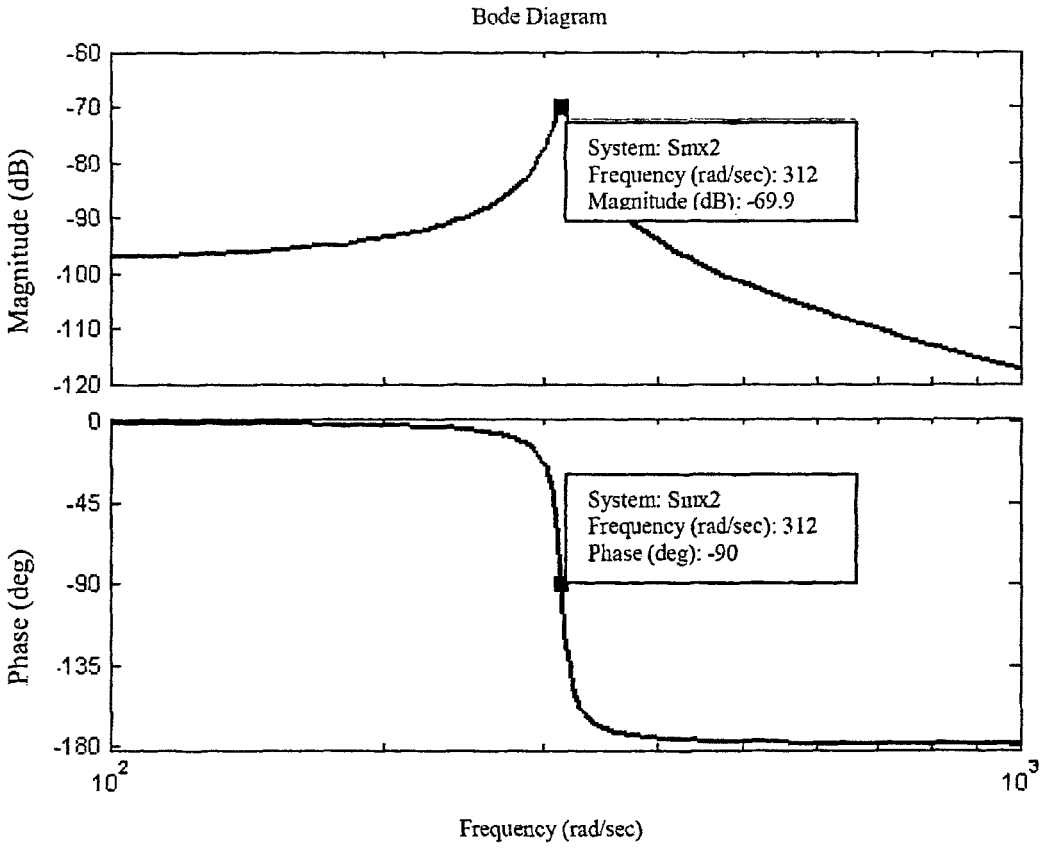
FIG. 5 illustrates a Bode diagram for the displacement of the mechanical system.
Figure 6:
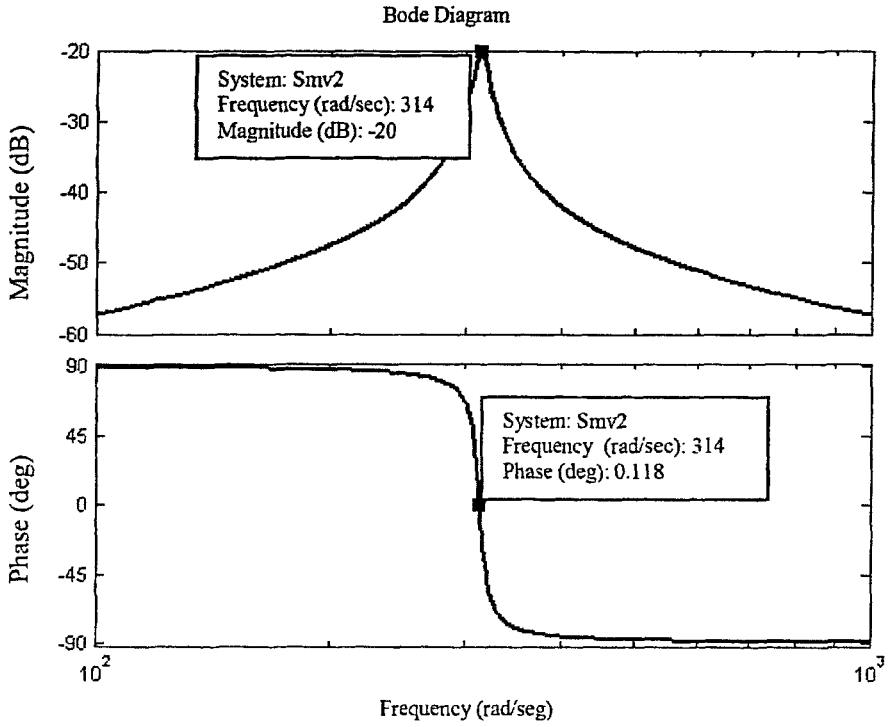
FIG. 6 shows a Bode diagram for the velocity of the mechanical system.

In Bode diagrams of the transfer function of displacement and velocity, for the mechanical system, such as shown in FIGS. 5 and 6, one can observe that, at the mechanical resonance frequency, the gain is maximum. In this case, the phase between the displacement with the current is of −90 degrees (displacement and current are in quadrature), and the phase of the velocity with the current is zero degree (velocity and current are in phase).

Figure 7:
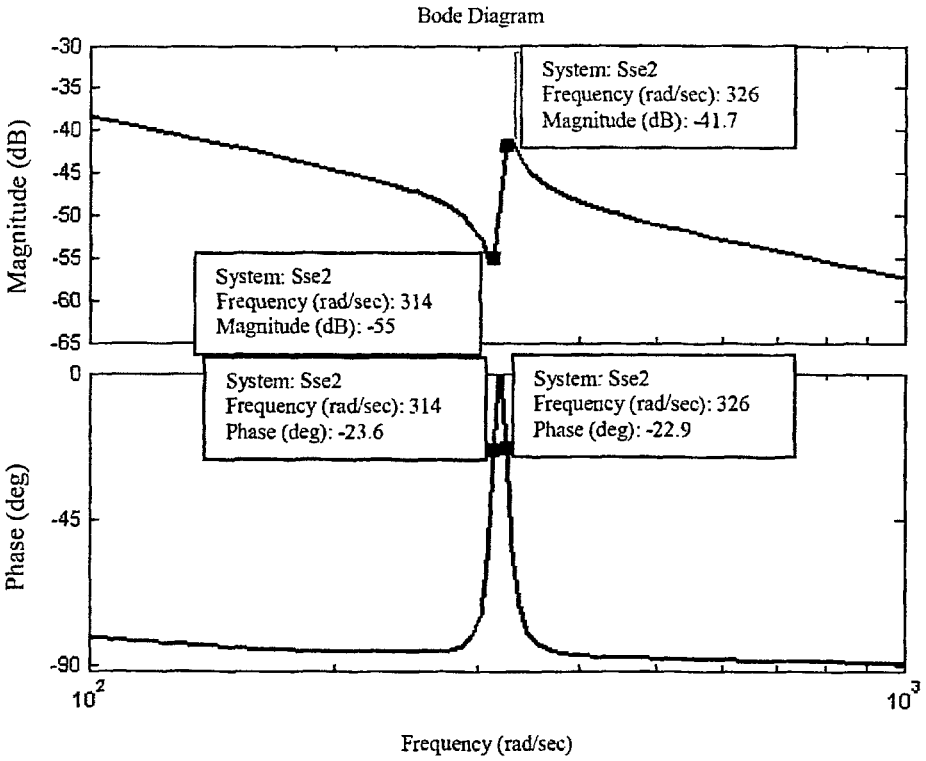
FIG. 7 illustrates a Bode diagram of the current of the complete electromechanical system of the present invention.
Figure 8:
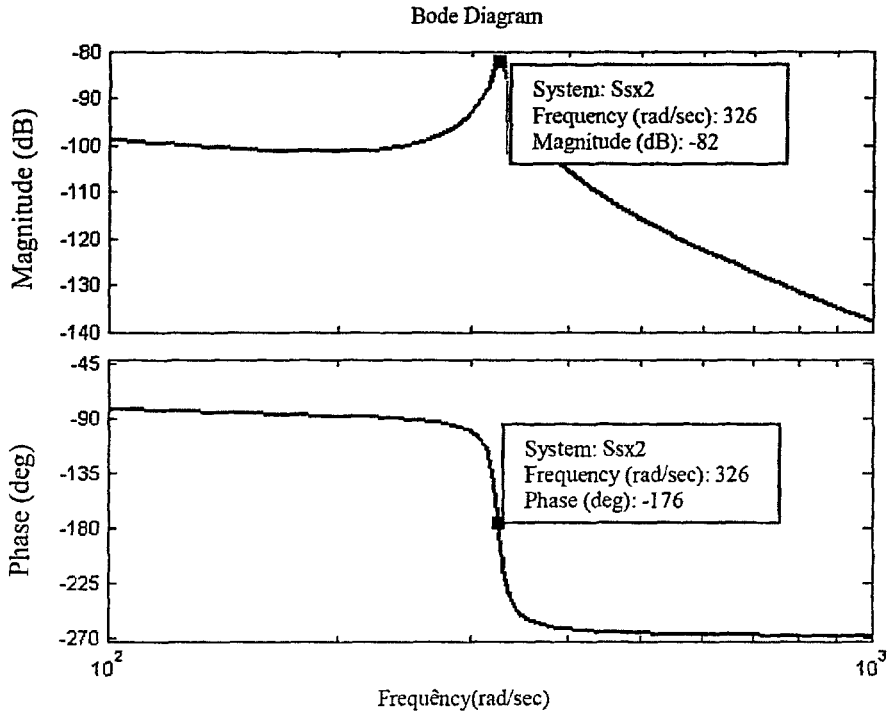
FIG. 8 illustrates a Bode diagram of the displacement of the complete electromechanical system, according to the teachings of the invention.
Figure 9:
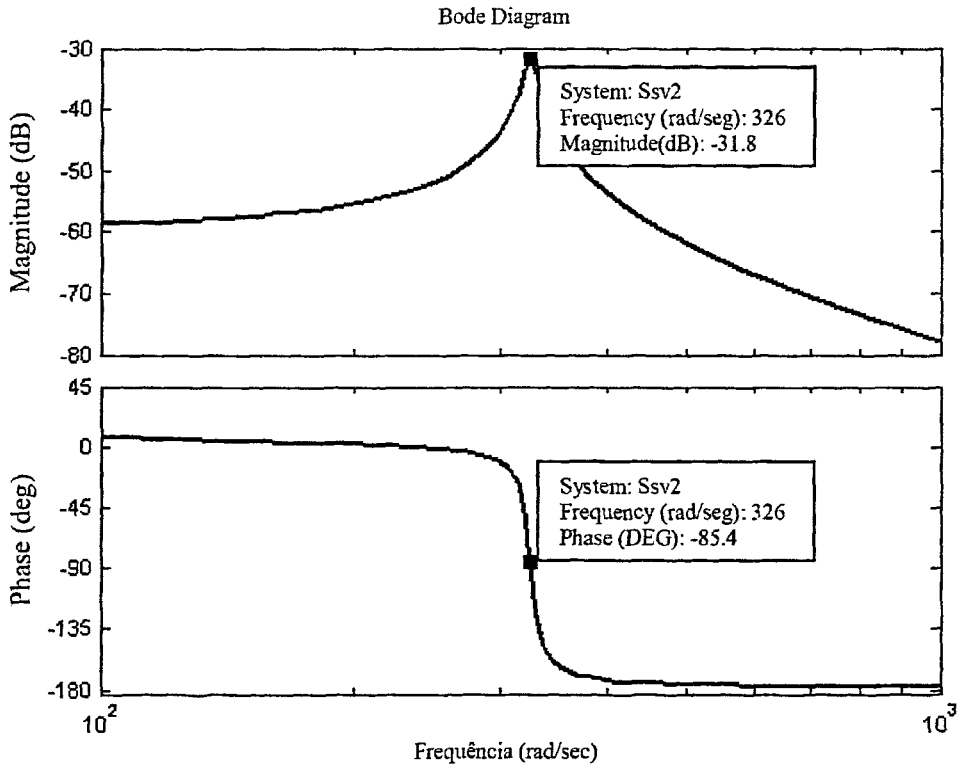
FIG. 9 illustrates a Bode diagram of the velocity of the complete electromechanical system of the present invention.
Figure 10:
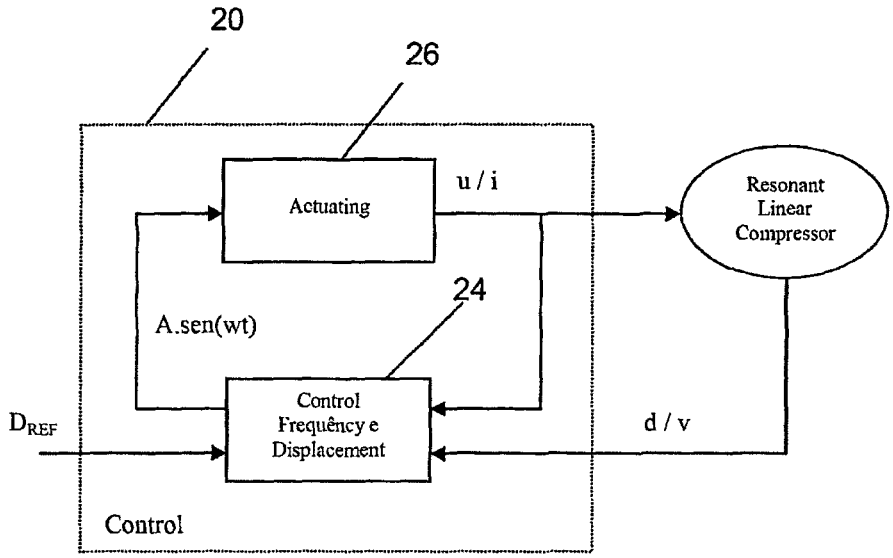
FIG. 10 represents a simplified block diagram of the control with a sensor.
Figure 11:
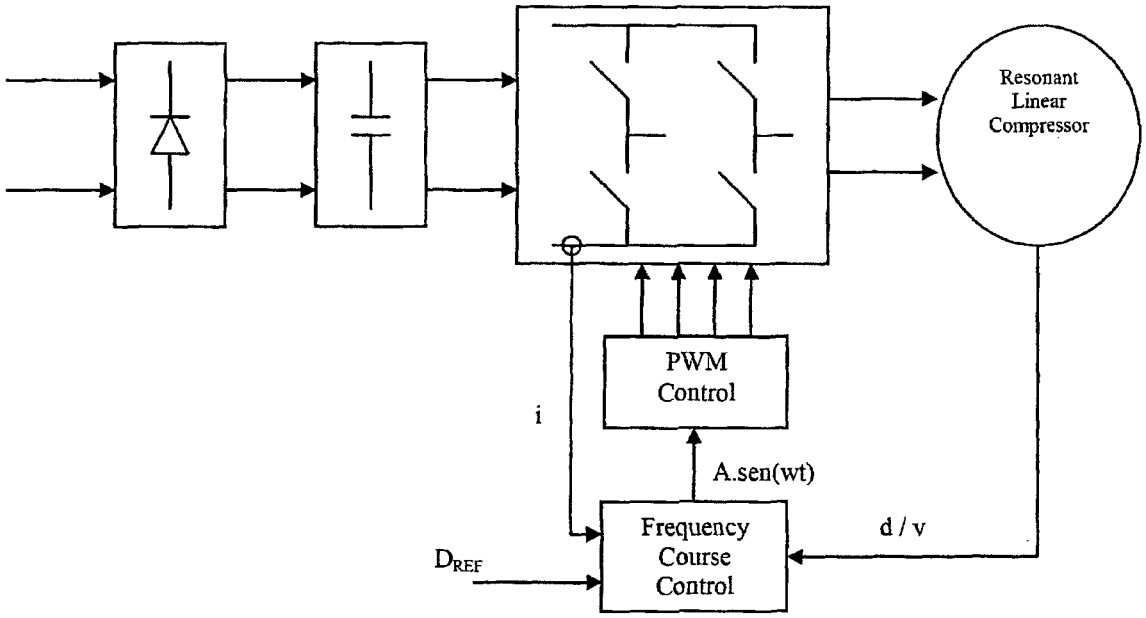
FIG. 11 illustrates a block diagram of the control and of the inverter with a sensor.
Figure 12:
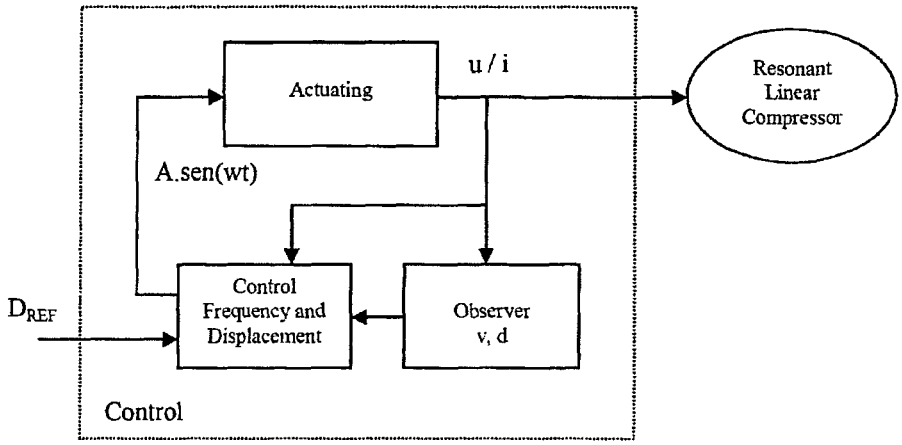
FIG. 12 shows a simplified block diagram of the control without sensor.
Figure 13:
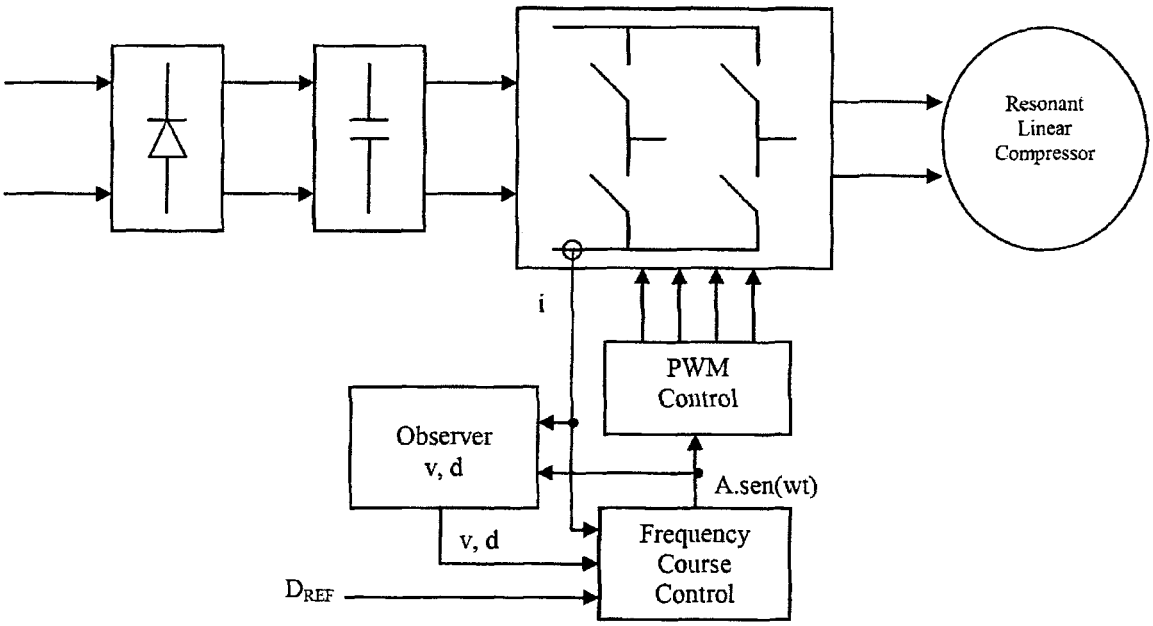
FIG. 13 shows a block diagram of the control and inverter without sensor.

Additionally, one observes from the diagrams of FIGS. 7, 8 and 9, represent, respectively, the Bode diagrams of the transfer functions of the current, the displacement of the velocity, as a function of the input voltage, which, at the electromechanical resonance frequency, the gain is maximum, according to the teachings of the present invention.

Moreover, it is possible to observe, in FIG. 7, that, in the mechanical resonance frequency, the value of the current is minimum, for which reason the efficiency is maximum. At the middle point between the mechanical resonance frequency and the electromechanical resonance frequency, the power factor of the linear actuator is maximum, since the phase of the current has the shortest delay.

The electromechanical resonance frequency is always above the mechanical resonance frequency, and at the electromechanical frequency the phase between the displacement and the input voltage is around −176 degrees, and the phase between the velocity and the input voltage is around −86 degrees, for the data presented in Table 1 above. The greater the difference between the real pole and the module of the pair of complex poles of the electromechanical system, the shift of the displacement and of the velocity will tend to −180 degrees and −90 degrees, respectively.

In the face of the foregoing, one proposes the present invention for the main purpose of supplying maximum power to the resonant linear compressor 50, for conditions of overload of the cooling system.

Such a system takes into account that the linear compressor 50—comprises at least one cylinder 2, at least one had 3, at least one electric motor and at least one spring, so that the cylinder 2 houses operatively a piston 1. FIG. 1 shows said compressor 50 and its constituent parts.

As far as the electronic composition is concerned, it is possible to note, on the basis of FIGS. 10-13, the main characteristics of the present actuation system. Such a system comprises at least one electronic actuation control 20 of the electric motor, this electronic actuation control 20 being provided with at least one control circuit 24 and at least one actuation circuit 26, associated electrically with each other.

The same figures show that the electronic actuation control 20 is electronically associated to the electric motor of the linear compressor 50, this electronic control 20 being composed of rectifying element, inverter (inverting bridge) and digital processor.

A quite relevant characteristic of the presently claimed invention as compared with the prior techniques refers to the fact that the actuation system is particularly configured to detect at least one overload condition of the linear compressor (50), through at least one electric magnitude measured or estimated by the electronic actuation control 20, and to adjust, from a control mode in overload, the actuation frequency of the electric motor to an electromechanical resonance frequency.

The electric magnitude measured or estimated is given by an actuating piston velocity value $V_p$, or still by a piston displacement value $d_p$. The actuation electronic control 20 is capable of actuating, according to the teachings of the invention, the electric motor of the compressor 50 with a PWM senoidal voltage starting from an amplitude and a controlled range.

As already mentioned before, the present invention has the central objective of detecting a condition of overload of the linear compressor 50, under conditions in which it is necessary to adjust the actuation frequency of said electric motor, in a determined operation mode in overload, in order to achieve the desired control of the cooling system in situations of high demand.

Figure 14:
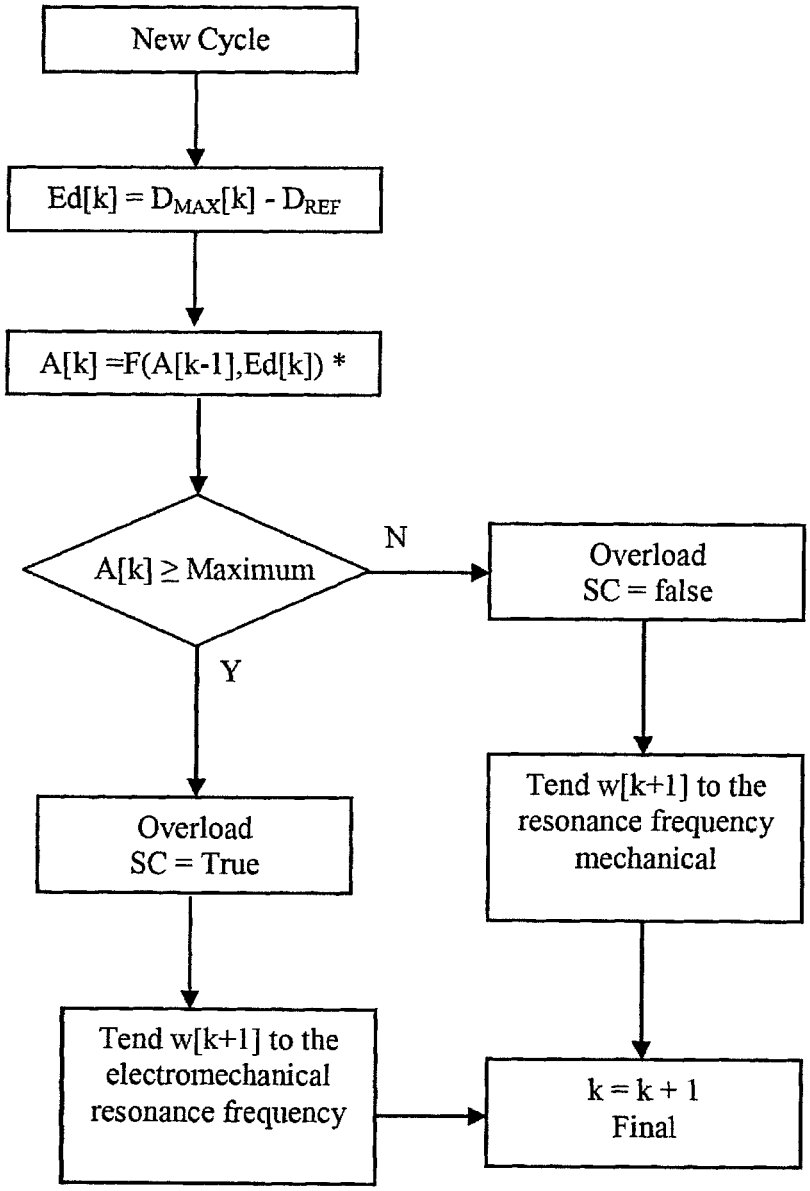
FIG. 14 shows first flow chart capable of detecting the overload mode in a normal control proposal.
Figure 15:
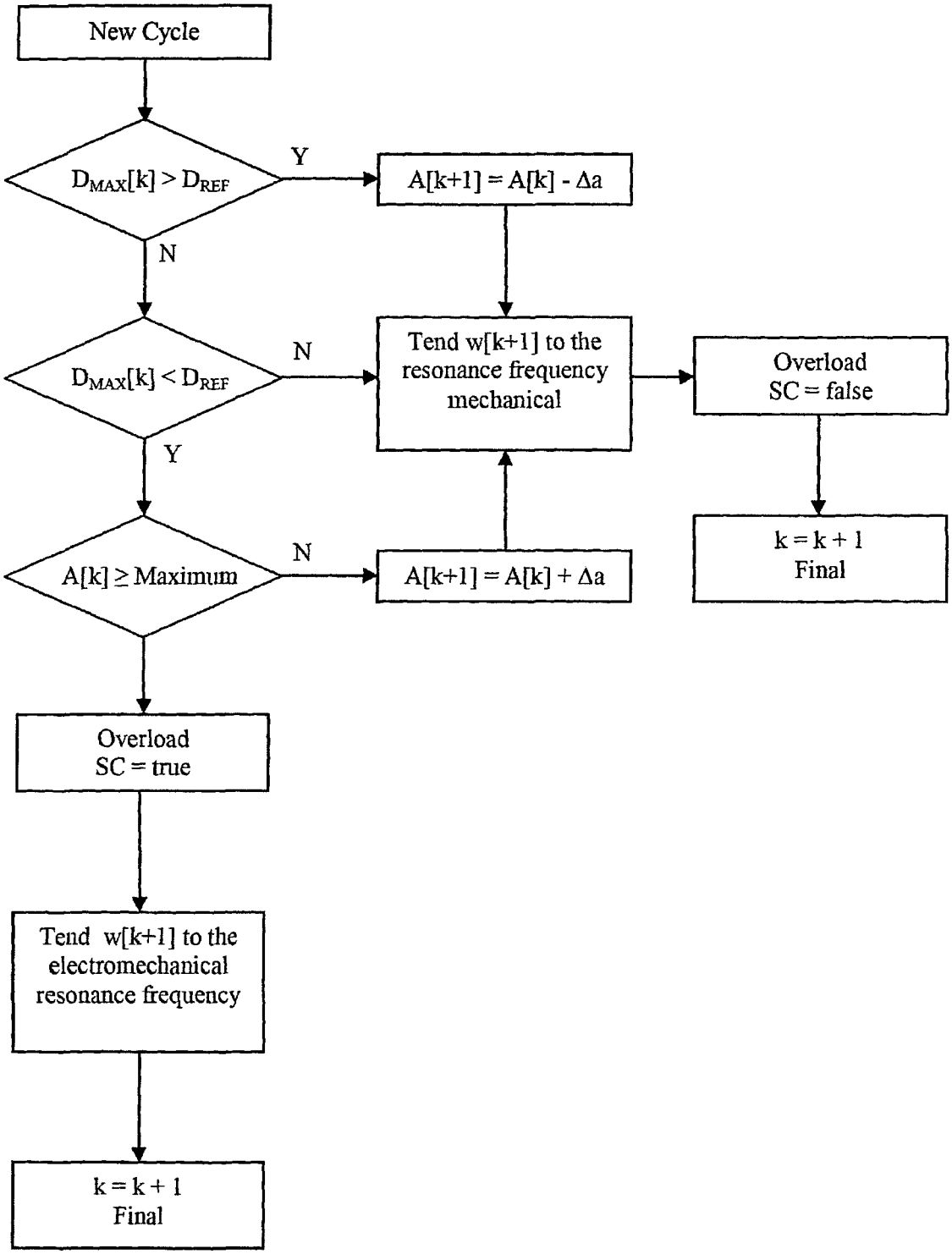
FIG. 15 shows second flow chart intended for detection of the overload mode in a second normal control proposal.
Figure 16:
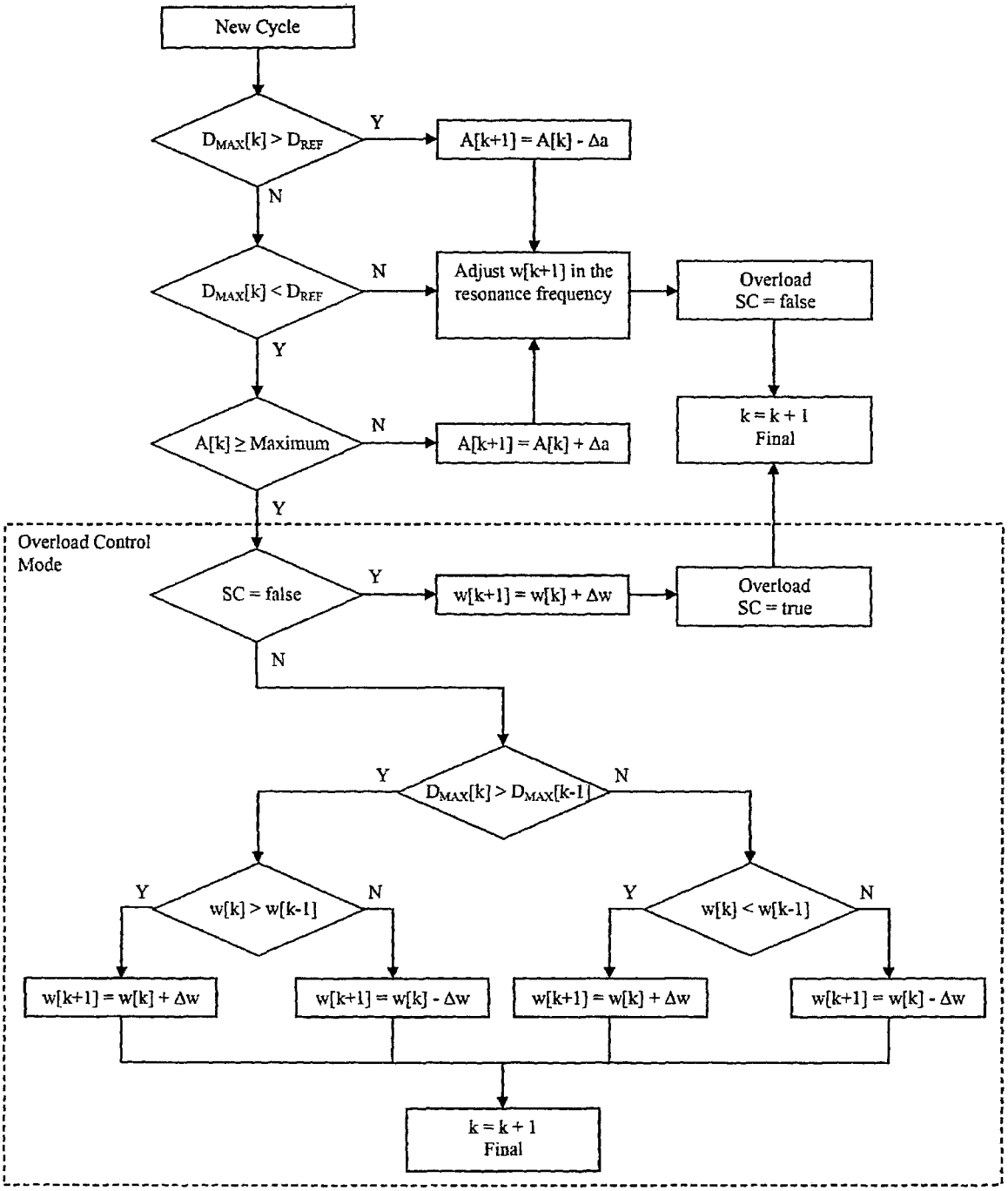
FIG. 16 shows an overload-control flow chart for maximum displacement.

One first way to control the motor of the compressor 50 in this condition is illustrated in FIG. 16. FIGS. 14 and 15 shows two flow charts oriented to detect the overload mode in two different proposals of normal control. In this case, the overload control mode is configured to adjust the actuation frequency of the electric motor by taking as a basis a piston displacement value de ((t)), or $D_{MAX}$[K], with respect to the maximum reference displacement $D_{REF}$. One observes that the function F illustrated in FIG. 14 (see second block A[k]=F(A[k−1],Ed[k]) may be a control P, PI or PID.

Figure 17:
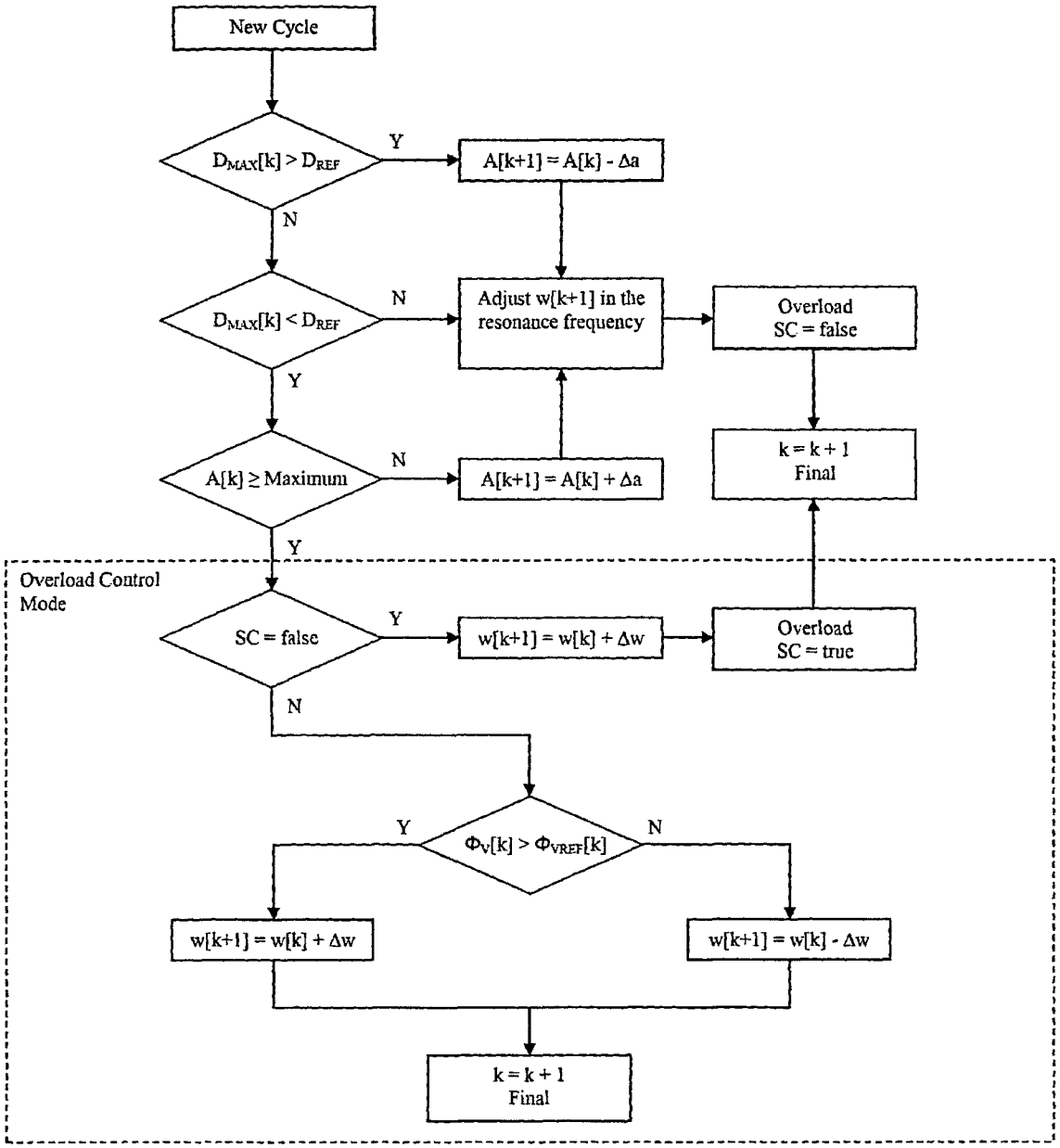
FIG. 17 shows an overload-control flow chart for the adjustment of the velocity phase.

In a second mode, as shown in FIG. 17, the overload control is configured to adjust the actuation frequency of the electric motor by taking as a basis a velocity phase φv of the motor of the compressor 50*m*, with respect to a reference velocity φREF.

Figure 18:
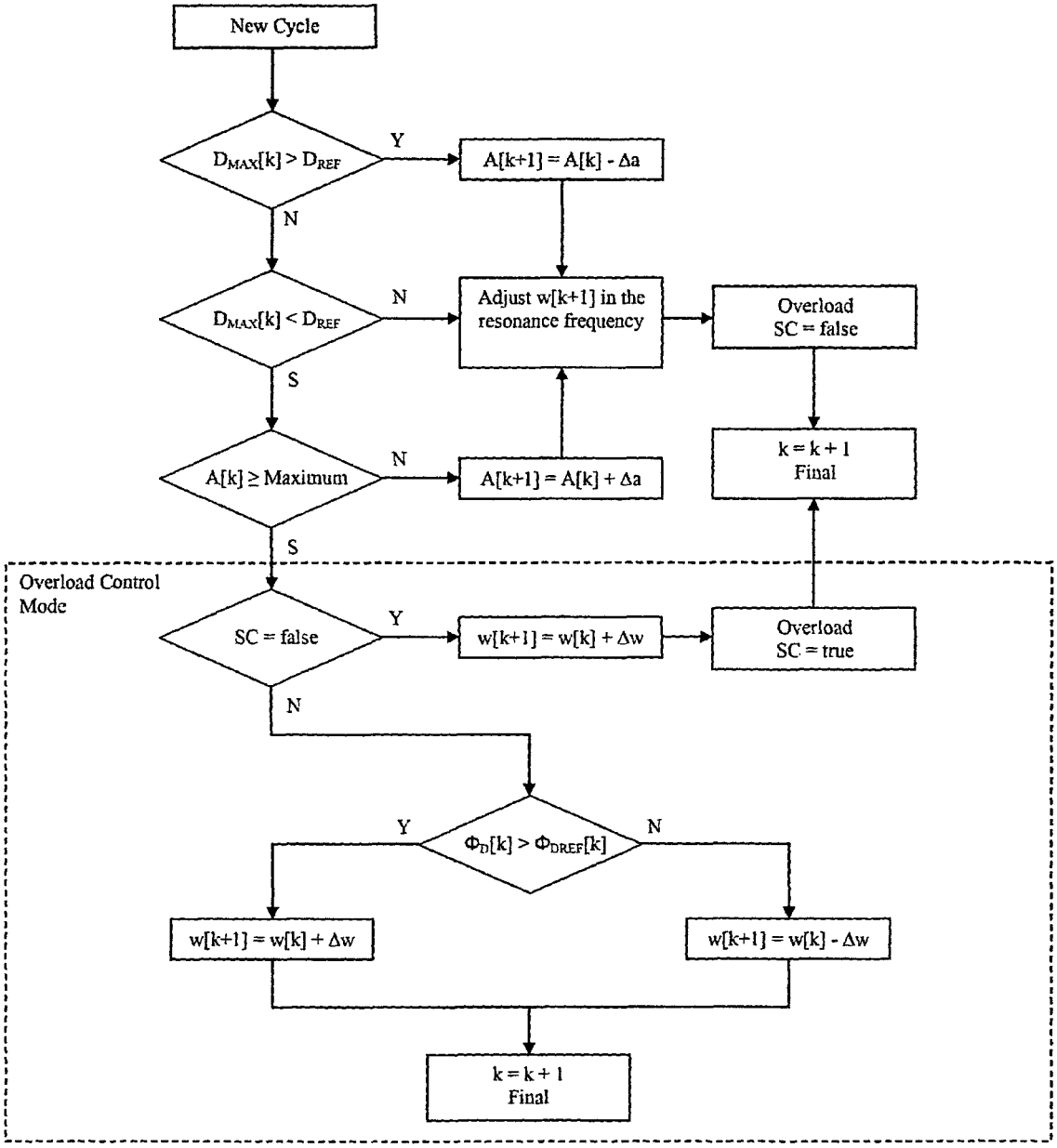
FIG. 18 shows an overload-control flow chart for the adjustment of the displacement phase.
Figure 19:
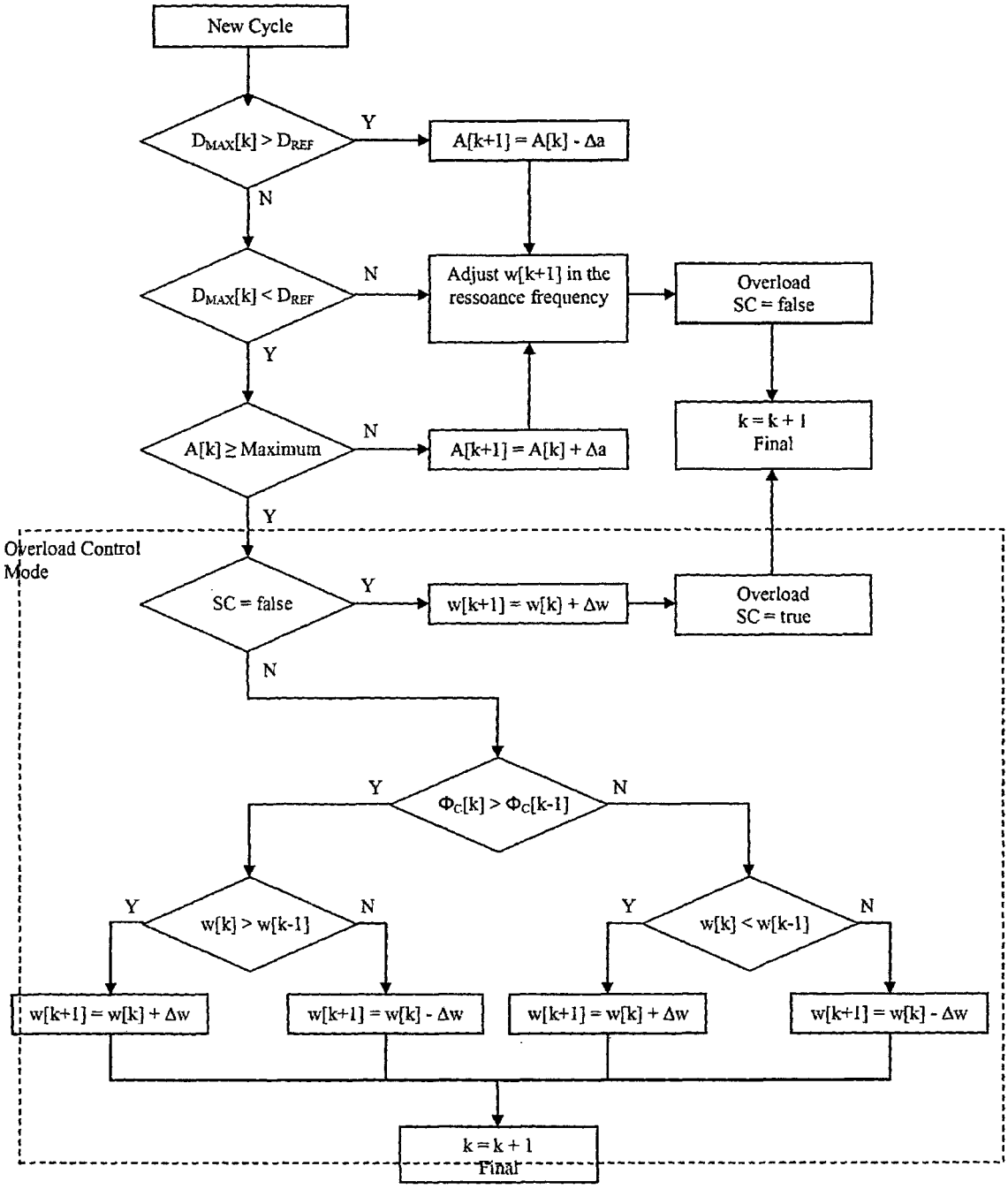
FIG. 19 shows an overload-control flow chart for minimum current shift.

A third way to adjust the actuation frequency of the compressor 50 is shown in FIG. 18. In this case, the overload control mode is configured to adjust the actuation frequency of the electric motor by taking as basis a value of the displacement phase $\varphi_d$ of the motor of the compressor, with respect to the reference displacement phase $\varphi_{dREF}$ Additionally, FIG. 19 shows an alternative way of adjusting the actuation frequency of said compressor 50. This is a way of controlling overload, configured to adjust the actuation frequency of the electric motor taking, as a basis, a minimum current phase value φc.

With regard to the above-described adjustment modes, they are given by the difference in phase between the piston displacement value ($d_e$(t)) and an input voltage phase ($V_{int.}$) preferably around −176 degrees (for the compressor defined by the parameters of Table 1). On the other hand, the adjustment of actuation frequency is given starting from the difference between the velocity phase value φv and an input voltage phase value Vint, preferably around −86 degrees (for the compressor defined by the parameters of Table 1).

The present invention has, as an innovative and differentiated characteristic over the prior art, a set of steps capable of adjusting the actuation frequency of the compressor 50 in an efficient and quite simplified manner for the overload control mode foreseen. Such a methodology takes into account the fact that said compressor comprises at least one electric motor, the latter being actuated by a frequency inverter. Said method comprises essentially the following steps:

a-) measuring and estimating, at every operation cycle $T_R$ of the resonant linear compressor 50, an actuation frequency $F_R$, a maximum piston displacement $d_e$(t) of the resonant linear compressor 50, and/or the piston displacement phase φd and/or the piston velocity phase φv and/or the current phase φc;

b-) comparing the maximum piston displacement $d_e$((t) with a maximum reference displacement $D_{REF}$, and calculating a displacement error Err;

c-) calculating an operation feed voltage value $_{Am\text{-}pop}$ of the electric motor, from an operation feed voltage value of previous cycle and of the displacement error Err obtained in the preceding step (s);

d-) comparing the operation feed voltage value $A_{mpop}$ of the electric motor calculated at the preceding step with a maximum feed voltage value Amax;

e-) if the operation feed voltage value $A_{mpop}$ calculated at step "c" is lower than or equal to the maximum feed voltage value $A_{max}$, then deactivate an overload control mode of the electric motor and decrease the actuation frequency $F_R$ down to a mechanical resonance frequency; and returning to step a-);

f-) if the operation feed voltage value $A_{mpop}$ calculated at step "c" is higher than the maximum feed voltage value $A_{max}$, then activate the overload control mode and increase the actuation frequency $F_R$ up to an electromechanical resonance frequency.

As to the first overload control mode, as illustrated in FIG. 16, one can state that it further comprises the following step:

n) comparing the maximum piston displacement de(t) with a maximum piston displacement of a cycle $d_e$(t−1) preceding the operation cycle $T_R$;

o) if the maximum piston displacement de(t) is higher than the piston displacement of the preceding cycle de(t), then comparing the actuation frequency $F_R$ with the actuation frequency of the preceding cycle $F_{R((t-1)}$;

p) if the actuation frequency $F_R$ is higher than the actuation frequency of preceding cycle $R_{F(t-1)}$, then increasing the actuation frequency $F_R$ by a frequency delta value $T_f$ and returning to step a);

q) if the actuation frequency $F_R$ is not higher than the actuation frequency of the preceding cycle $F_{R(t-1)}$, then decreasing the actuation frequency $F_R$ by a frequency delta value $T_f$ and returning to step a);

r) if the maximum piston displacement $d_e$(t) is not greater than the maximum piston displacement of preceding cycle $d_e$(t−1), then comparing the actuation frequency $F_R$ with an actuation frequency of preceding cycle $F_{R(t-1)}$;

s) if the actuation frequency $F_R$ is lower than that actuation frequency of preceding cycle $F_{R(t-1)}$, then increasing the actuation frequency $F_R$ by a frequency delta value $T_f$ and returning to step a);

t) if the actuation frequency $F_R$ is not lower than the actuation frequency of preceding cycle $F_{R(t-1)}$, then decreasing the actuation frequency $F_R$ by a frequency delta value $T_f$ and returning to step a).

It should be pointed out that steps "n" to "t" define an overload control mode for a maximum piston displacement value of the compressor 50.

For the second overload control mode, as shown in FIG. 17, the following steps are foreseen:

n) calculating a velocity phase φv of the piston of the compressor 50;

o) comparing the velocity phase φv, calculated at the preceding step, with a reference velocity phase value $\varphi_{VREF}$;

p) if the velocity phase φv is higher than the reference velocity phase $\varphi_{VREF}$, then increase the actuation frequency $F_R$ by a frequency delta value $T_f$ and returning to step a);

q) if the velocity phase φv is not higher than the reference velocity phase $\varphi v_{VREF}$, then decrease the actuation frequency $F_R$ by a frequency delta value $T_f$ and returning to step a).

for this second control mode, steps "n" to "q" define an overload control mode of the compressor 50 for an adjustment of reference velocity phase around −90 degrees (−86 for the compressor defined by the parameters of Table 1).

A third way to adjust the actuation frequency, according to the teachings of the present invention, and as illustrated in FIG. 18, comprises the following steps:

n) calculating a piston displacement phase $\varphi_d$ of the compressor 50;

o) comparing the displacement phase $\varphi_d$ calculated at the preceding step with a reference displacement phase value $\varphi_{DREF}$;

p) if the displacement phase φd is higher than the reference displacement phase $\varphi_{DREF}$, then increase the actuation frequency $F_R$ by a frequency delta value $T_f$ and returning to step a);

q) if the displacement phase φd is not higher than the reference displacement phase $\varphi_{DREF}$, then decrease the actuation frequency $F_R$ by a frequency delta value $T_f$ and returning to step a).

The last steps "n" to "q" above define an overload control mode of the compressor 50 for an adjustment of reference displacement phase around −180 (−176 degrees for the compressor defined by the parameters of table 1).

In turn, FIG. 19 shows a fourth way of adjusting the actuation frequency of the electric motor, consisting of the following steps:

n) calculating a current phase φc of the compressor 50;

o) comparing the current phase φc calculated at the preceding step with a current phase value φc−1 preceding the operation cycle TR;

p) if the current phase φc is higher than the previous cycle current phase value φc−1, then comparing the actuation frequency $F_R$ with a previous cycle actuation frequency $F_R(t-1)$;

q) if the actuation frequency $F_R$ is higher than the previous cycle actuation frequency $F_R(t-1)$, then increase the actuation frequency $F_R$ by a frequency delta value $T_f$ and returning to step a);

r) if the actuation frequency $F_R$ is not higher than the previous cycle actuation frequency $F_R(-1)$, then decrease the actuation frequency $F_R$ by a frequency delta value $T_f$ and returning to step a);

s) if the current phase value φc is not higher than the previous cycle current phase value φc−1, then comparing the actuation frequency $F_R$ with a previous cycle actuation frequency $F_R(t-1)$;

t) if the actuation frequency $F_R$ is lower than the previous cycle actuation frequency $F_R(t-1)$, then increase the actuation frequency $F_R$ by a frequency delta value Tf and returning to step a);

u) if the actuation frequency Fr is not lower than the previous cycle actuation frequency $F_R(t-1)$, then decrease the actuation frequency $F_R$ by a frequency delta value Tf and returning to step a);

for steps "n" and "u" above, one defines an overload control mode of the compressor 50 for a minimum current shift.

It should be pointed out that, as the piston displacement reaches the maximum reference value and reaches the resonance frequency again, the present system and method are configured to come out of the overload control.

On the other hand, the present invention foresees a resonant linear compressor 50 provided with the presently designed actuation system and with the actuation method as defined in the claimed object.

Finally, one can state that the actuation system and method for a resonant linear compressor 50 as described above achieve their objectives inasmuch as it is possible to increase the maximum power supplied to said compressor ion conditions of high load or overload for the same equipment design.

Moreover, it should be pointed out that the present invention enables better preservation of the foods of the cooling equipment by increasing the maximum power supplied to said compressor. Further, it is possible, on the bases of the teachings of the invention, to reduce manufacture costs of the final product, as well as to increase the efficiency of the compressor 50 in its nominal operation condition, taking into account a better sizing of its linear actuator.

A preferred example of embodiment having been described, one should understand that the scope of the present invention embraces other possible variations, being limited only by the contents of the accompanying claims, which include the possible equivalents.

The invention claimed is:

1. An actuation method for a resonant linear compressor (50), the resonant linear compressor (50) comprising at least one electric motor, the electric motor being actuated by a frequency inverter, the actuation method comprising the following steps:

a-) measuring or estimating, at every operation cycle ($T_R$) of the resonant linear compressor (50), at least an actuation frequency ($F_R$) and a maximum piston displacement ($d_e(t)$) of the resonant linear compressor (50);

b-) comparing the maximum piston displacement (de(t)) with a maximum reference displacement ($D_{REF}$), and calculating a displacement error (Err);

c-) calculating an operation feed voltage value ($A_{mpop}$) of the electric motor from an operation feed voltage value of a preceding cycle that precedes the operation cycle ($T_R$) and from the displacement error (Err) obtained at the preceding step;

d-) comparing the operation feed voltage value ($A_{mpop}$) of the electric motor calculated at the preceding step with a maximum feed voltage value ($A_{max}$);

e-) if the operation feed voltage value ($A_{mpop}$) calculated at step "c" is lower than or equal to the maximum feed voltage value ($A_{max}$), then deactivate an overload control mode of the electric motor and decrease the actuation frequency ($F_R$) down to a mechanical resonance frequency value, and return to step a);

f-) if the operation feed voltage value ($A_{mpop}$) calculated at step "c" is higher than the maximum feed voltage value ($A_{max}$), then activate the overload control mode and increase the actuation frequency ($F_R$) up to an electromechanical resonance frequency;

wherein the overload control mode further comprises the following steps:

g) comparing the maximum piston displacement ($d_e(t)$) with a piston displacement value of the preceding cycle ($d_e(t-1)$);

h) if the maximum piston displacement ($d_e(t)$) is greater than the piston displacement of the preceding cycle ($d_e(t-1)$), then compare the actuation frequency ($F_R$) with an operation frequency of the preceding cycle ($F_R(t-1)$;

i) if the actuation frequency ($F_R$) is higher than the actuation frequency of the preceding cycle ($F_R(t-1)$), then increase the actuation frequency ($F_R$) by a frequency delta value ($T_f$) and return to step a);

j) if the actuation frequency ($F_R$) is not higher than the actuation frequency of the previous cycle ($F_R(t-1)$), then decrease the actuation frequency ($F_R$) by a frequency delta value ($T_f$) and return to step a);

k) if the maximum piston displacement ($d_e(t)$) is not greater than the maximum piston displacement of the preceding cycle ($d_e(t-1)$), then compare the actuation frequency ($F_R$) with the actuation frequency of the preceding cycle ($F_R(t-1)$);

l) if the actuation frequency ($F_R$) is lower than the actuation frequency of the preceding cycle ($F_R(t-1)$), then increase the actuation frequency ($F_R$) by a frequency delta value (Tf) and return to step a);

m) if the actuation frequency ($F_R$) is not higher than the actuation frequency of the preceding cycle ($F_R(t-1)$), then decrease the actuation frequency ($F_R$) by a frequency delta value ($T_f$) and return to step a).

2. The actuation method according to claim 1, further comprising the following steps:

n) calculating the velocity phase ($\varphi_v$) of the piston of the compressor (50);

o) comparing the velocity phase ($\varphi_v$) of the piston of the compressor (50) with a reference velocity phase value ($\varphi_{VREF}$);

p) if the velocity phase ($\varphi_V$) is higher than the reference velocity phase ($\varphi_{VREF}$), then increase the actuation frequency ($F_R$) by a frequency delta value ($T_f$) and return to step a);

q) if the velocity phase ($\varphi_v$) is not higher than the reference velocity phase ($\varphi_{VREF}$), then decrease the actuation frequency ($F_R$) by a frequency delta value ($T_f$) and return to step a);

wherein the steps "n" to "q" relate to the overload control mode of the compressor (50) for an adjustment of the frequency velocity phase around −90 degrees.

3. The actuation method according to claim 1, further comprising the following steps:

n) calculating a displacement phase ($\varphi_d$) of the piston of the compressor (50);

o) compare the displacement phase ($\varphi_d$) calculated at the preceding step with a reference displacement phase value ($\varphi_{DREF}$);

p) if the displacement phase ($\varphi_d$) is greater than the reference displacement phase ($\varphi_{DREF}$), then increase the actuation frequency ($F_R$) by a frequency delta value ($T_f$) and return to step a);

q) if the displacement phase ($\varphi_d$) is not greater than the reference displacement phase ($\varphi_{DREF}$), then decrease the actuation frequency ($F_R$) by a frequency delta value ($T_f$) and return to step a);

wherein the steps "n" and "q" relate to the overload control mode of the compressor (50) for an adjustment of reference displacement phase around −180 degrees.

4. The actuation method for a resonant linear compressor as set forth in claim 1, wherein said step a-) of measuring or estimating further comprises:

measuring or estimating, at every operation cycle ($T_R$) of the resonant linear compressor (50), at least one of a piston displacement phase ($\varphi_d$), a piston velocity phase ($\varphi_v$), a current phase ($\varphi_c$).

5. An actuation method for a resonant linear compressor (50), the resonant linear compressor (50) comprising at least one electric motor, the electric motor being actuated by a frequency inverter, the actuation method comprising the following steps:

a-) measuring or estimating, at every operation cycle ($T_R$) of the resonant linear compressor (50), at least an actuation frequency ($F_R$) and a maximum piston displacement ($d_e(t)$) of the resonant linear compressor (50);

b-) comparing the maximum piston displacement (de(t)) with a maximum reference displacement ($D_{REF}$), and calculating a displacement error (Err);

c-) calculating an operation feed voltage value ($A_{mpop}$) of the electric motor from an operation feed voltage value of a preceding cycle that precedes the operation cycle ($T_R$) and from the displacement error (Err) obtained at the preceding step;

d-) comparing the operation feed voltage value ($A_{mpop}$) of the electric motor calculated at the preceding step with a maximum feed voltage value ($A_{max}$);

e-) if the operation feed voltage value ($A_{mpop}$) calculated at step "c" is lower than or equal to the maximum feed voltage value ($A_{max}$), then deactivate an overload control mode of the electric motor and decrease the actuation frequency ($F_R$) down to a mechanical resonance frequency value, and return to step a);

f-) if the operation feed voltage value ($A_{mpop}$) calculated at step "c" is higher than the maximum feed voltage value ($A_{max}$), then activate the overload control mode and increase the actuation frequency ($F_R$) up to an electromechanical resonance frequency;

wherein the overload control mode further comprises:

n) calculating a current phase ($\varphi_c$) of the compressor (50);

o) comparing the current phase ($\varphi_c$) calculated at the preceding step with a current phase value of the preceding cycle ($\varphi_c$−1);

p) if the current phase ($\varphi_c$) is higher than the current phase value of the preceding cycle ($\varphi_c$−1), then compare the actuation frequency ($F_R$) with an actuation frequency of the preceding cycle ($F_R$(t−1));

q) if the actuation frequency ($F_R$) is higher than the actuation frequency of the preceding cycle ($F_R$(t−1)), then increase the actuation frequency ($F_R$) by a frequency delta value ($T_f$) and return to step a);

r) if the actuation frequency ($F_R$) is not higher than the actuation frequency of the preceding cycle ($F_R$(t−1)), then decrease the actuation frequency ($F_R$) by a frequency delta value ($T_f$) and return to step a);

s) if the current phase value ($\varphi_c$) is not higher than the current phase value of the preceding cycle (φc−1), then compare the actuation frequency ($F_R$) with an actuation frequency of the preceding cycle ($F_R$(t−1));

t) if the actuation frequency ($F_R$) is lower than the actuation frequency of the preceding cycle ($F_R$(t−1)), then increase the actuation frequency ($F_R$) by a frequency delta value ($T_f$) and return to step a);

u) if the actuation frequency ($F_R$) is not lower than the actuation frequency of the preceding cycle $F_R$(t−1)), then decrease the actuation frequency ($F_R$) by a frequency delta value ($T_f$) and return to step a);

wherein the steps "n" to "u" relate to the overload control mode of the compressor (50) for a minimum current shift.

6. The actuation method for a resonant linear compressor as set forth in claim 5, wherein said step a-) of measuring or estimating further comprises:

measuring or estimating, at every operation cycle ($T_R$) of the resonant linear compressor (50), at least one of a piston displacement phase ($\varphi_d$), a piston velocity phase ($\varphi_v$), a current phase ($\varphi_c$).

* * * * *